US010863831B2

(12) United States Patent
Ocegueda Gallaga et al.

(10) Patent No.: US 10,863,831 B2
(45) Date of Patent: Dec. 15, 2020

(54) SYSTEMS AND METHODS FOR AIR MATTRESS PRESSURE CONTROL

(71) Applicant: POLYGROUP MACAU LIMITED (BVI), Tortola (VG)

(72) Inventors: Victor Hugo Ocegueda Gallaga, Baja California (MX); Jason Loomis, Decatur, GA (US)

(73) Assignee: Polygroup Macau Limited (BVI), Road Town (VG)

( * ) Notice: Subject to any disclaimer, the term of this patent is extended or adjusted under 35 U.S.C. 154(b) by 651 days.

(21) Appl. No.: 15/664,543

(22) Filed: Jul. 31, 2017

(65) Prior Publication Data

US 2018/0027984 A1 Feb. 1, 2018

Related U.S. Application Data

(60) Provisional application No. 62/369,415, filed on Aug. 1, 2016.

(51) Int. Cl.
*A47C 27/08* (2006.01)

(52) U.S. Cl.
CPC ..... *A47C 27/083* (2013.01); *A47C 27/082* (2013.01)

(58) Field of Classification Search
CPC ..... A47C 27/10; A47C 27/08
USPC ..... 5/710, 713, 714
See application file for complete search history.

(56) References Cited

U.S. PATENT DOCUMENTS

| | | | | |
|---|---|---|---|---|
| 4,797,962 | A * | 1/1989 | Goode | A61G 7/05769 417/302 |
| 5,586,347 | A * | 12/1996 | Frischknecht | A47C 4/54 5/708 |
| 7,089,618 | B1 | 8/2006 | Metzger | |
| 8,562,773 | B2 | 10/2013 | Lin et al. | |
| 9,156,203 | B2 | 10/2015 | Lin et al. | |
| 9,247,827 | B2 | 2/2016 | Lin et al. | |
| D765,443 | S | 9/2016 | Lin et al. | |
| 2004/0133986 | A1 | 7/2004 | Hayes | |
| 2007/0056115 | A1* | 3/2007 | Flick | A47C 20/048 5/713 |
| 2008/0109964 | A1 | 5/2008 | Flocard et al. | |
| 2013/0228268 | A1 | 9/2013 | Lin et al. | |
| 2013/0230670 | A1 | 9/2013 | Lin et al. | |
| 2013/0230671 | A1 | 9/2013 | Lin et al. | |
| 2014/0277611 | A1 | 9/2014 | Nunn et al. | |

(Continued)

FOREIGN PATENT DOCUMENTS

| | | |
|---|---|---|
| CN | 2930467 Y | 8/2007 |
| CN | 201019353 Y | 2/2008 |

(Continued)

OTHER PUBLICATIONS

International Search Report and Written Opinion from related PCT/US17/44793, dated Oct. 18, 2017, 9 pages.

*Primary Examiner* — Fredrick C Conley
(74) *Attorney, Agent, or Firm* — Troutman Pepper Hamilton Sanders LLP; Ryan A. Schneider; Christopher C. Close, Jr.

(57) ABSTRACT

The disclosed technology includes a pressure-controlled air mattress for enabling a user to set a desired firmness or pressure level of the air mattress. The pressure-controlled air mattress may automatically maintain the desired pressure by replacing leaked air with air from a pressurized air reservoir.

20 Claims, 3 Drawing Sheets

(56) References Cited

U.S. PATENT DOCUMENTS

| | | | |
|---|---|---|---|
| 2014/0332139 | A1 | 11/2014 | Lin et al. |
| 2014/0332142 | A1 | 11/2014 | Lin et al. |
| 2015/0201760 | A1 | 7/2015 | Lin et al. |
| 2015/0335164 | A1 | 11/2015 | Liu |
| 2016/0106344 | A1 | 4/2016 | Nazari |
| 2016/0135607 | A1 | 5/2016 | Ocegueda et al. |

FOREIGN PATENT DOCUMENTS

| | | | |
|---|---|---|---|
| CN | 201032956 | Y | 3/2008 |
| CN | 201599174 | U | 10/2010 |
| CN | 202234135 | U | 5/2012 |
| CN | 102602598 | A | 7/2012 |
| CN | 202536548 | U | 11/2012 |
| CN | 202536827 | U | 11/2012 |
| CN | 102990929 | A | 3/2013 |
| CN | 103110297 | A | 5/2013 |
| CN | 202919638 | U | 5/2013 |
| CN | 203137718 | U | 8/2013 |
| CN | 203137719 | U | 8/2013 |
| CN | 203296407 | U | 11/2013 |
| CN | 103600502 | A | 2/2014 |
| CN | 203735815 | U | 7/2014 |
| CN | 203852092 | U | 10/2014 |
| CN | 102578859 | B | 11/2014 |
| CN | 204218433 | U | 3/2015 |
| CN | 204232695 | U | 4/2015 |
| CN | 102578860 | B | 5/2015 |
| CN | 204599945 | U | 9/2015 |
| CN | 303354844 | S | 9/2015 |
| CN | 105342261 | A | 2/2016 |
| DE | 4302778 | A1 | 8/1994 |
| ES | 1029019 | U | 4/1995 |
| JP | 2016013315 | A | 1/2016 |
| WO | 2013130117 | A1 | 9/2013 |
| WO | 2016106344 | A1 | 6/2016 |

* cited by examiner

SYSTEMS AND METHODS FOR AIR MATTRESS PRESSURE CONTROL

CROSS-REFERENCE TO PRIORITY CLAIM

This application claims the benefit, under 35 U.S.C. § 119(e), of U.S. Provisional Patent Application No. 62/369,415, filed 1 Aug. 2016, entitled "Systems for Air Mattress Pressure Control," the entire contents and substance of which is incorporated herein by reference in their entirety as if fully set forth below.

TECHNICAL FIELD

Aspects of the present disclosure relate to systems for air mattress pressure control, and, more particularly, for silently, or substantially silently, maintaining a desired air pressure within the mattress.

BACKGROUND

Air mattresses are commonly used in lieu of traditional box-spring mattresses, memory foam mattresses, waterbeds, and other beds, as pressure structures on which people may sleep. Typically, air mattresses consist of a soft and flexible material chamber with an airtight seal that allows the air mattress to inflate during use and deflate after use.

Due to imperfections in manufacturing, slight leakages of air are generally inevitable for inflatable products. Consequently, a user may have to check the inflation pressure of air mattress regularly. In order to convenience the user, a built-in electric air pump may conveniently inflate the air mattress by way of sensing the pressure level and inflating or deflating the air mattress to increase or decrease the inside pressure at the predefined user set point. But a built-in electric air pump may be noisy and may cause a sleeping user to awaken if automatically activated at night.

SUMMARY

The above needs and others may be addressed by certain implementations of the disclosed technology.

According to some embodiments, an air mattress system can comprise an air mattress having a main chamber and an air reservoir in fluid connection with the main chamber, and the air reservoir can include an air reservoir valve. The air mattress system can include an air flow control element that is in fluid connection with the main chamber and in separate fluid connection with the air reservoir, and the air flow control element can include an air flow control valve. The air mattress system can also include a pressure control system in fluid connection with the air flow control element, and the pressure control system can include a pump.

In some embodiments, the pressure control system can be operable to pump air into the main chamber and the air reservoir.

In some embodiments, the air flow control valve can be operable to selectively direct air flow between the air intake, the main chamber, and/or the air reservoir.

In some embodiments, the air reservoir can be a substantially airtight compartment, and the air reservoir can be capable of receiving, holding, and releasing pressurized air.

In some embodiments, the air reservoir valve can be operable to open such that air may be released from the air reservoir into the main chamber.

In some embodiments, the pump can be integral with the air mattress.

In some embodiments, the pump can be external to the air mattress.

In some embodiments, the air mattress system can further comprise a main chamber pressure sensor operable to monitor an air pressure of the main chamber.

In some embodiments, the pressure control system can further include an air intake in fluid communication with an external air source and the air flow control element, a pump controller operable to control the pump, and a pressure controller in electrical communication with the main chamber pressure sensor In some embodiments, the external air can be ambient air.

In some embodiments, the air reservoir can be a substantially airtight compartment capable of receiving, holding, and releasing pressurized air, and the air flow control valve can be operable to selectively direct air flow between the air intake, the main chamber, and/or the air reservoir. The air reservoir valve can be operable to open and close such that air may be released from the air reservoir into the main chamber, and the air mattress system can further comprise a processor with memory. The processor can be configured to control the pump controller and the pressure controller and to receive pressure values from the main chamber pressure sensor.

In some embodiments, the air mattress system can further comprise a user interface in electrical communication with the processor, and the user interface can be configured to receive user input indicative of a desired mattress pressure.

In some embodiments, the air reservoir can further include an air reservoir pressure sensor operable to monitor an air pressure of the air reservoir. The processor can be configured to, upon receiving the desired mattress pressure, send instructions to the pump controller to engage the pump, and can be configured to, upon receiving a pressure value from the main chamber pressure sensor that equals the desired mattress pressure, send instructions to the air flow control valve to divert air flow from the pump to the air reservoir. The processor can be further configured to receive pressure values from the air reservoir pressure sensor, and the processor can be configured to, upon receiving a pressure value from the air reservoir pressure sensor that is greater than the desired mattress pressure, send instructions to the pump controller to disengage the pump In some embodiments, the processor can be in electrical communication with a source of time information. The processor can be further configured to, if an air pressure of the main chamber is below the desired mattress pressure or if an air pressure of the air reservoir is below the pressure value that is greater than the desired mattress pressure, send instructions, at a predetermined time of day or during a predetermined range of times, to the pressure controller and/or pump controller such that the pump pumps air into the main chamber until the air pressure of the main chamber equals the desired mattress pressure and/or into the air reservoir until the air pressure of the air reservoir is greater than the desired mattress pressure.

In some embodiments, after the main chamber is initially inflated to the desired mattress pressure and the air reservoir is initially filled to a pressure value that is greater than the desired mattress pressure, the processor can be configured to, if the processor receives a pressure value from the main chamber pressure sensor that is less than the desired mattress pressure, send instructions to the air reservoir valve to open.

According to some embodiments, a system for controlling the air pressure of an inflatable object can comprise an air flow controller in separate fluid connection with a main chamber of the inflatable object, an air reservoir, and a pump. The air reservoir can include a reservoir valve operable to open and establish fluid connection between the air reservoir and the main chamber and to close, and the air flow controller can be operable to selectively direct air flow between the pump, the main chamber, and/or the air reservoir. The system can include a main chamber pressure sensor that can be configured to monitor an air pressure of the main chamber, a reservoir pressure sensor that can be configured to monitor an air pressure of the air reservoir, and a user input interface that can be configured to receive user input indicative of a desired pressure. The system can include a processor with memory, and the processor can be in electrical communication with the user input interface, the main chamber pressure sensor, and the reservoir pressure sensor and can be configured to receive pressure values from the main chamber pressure sensor and the reservoir pressure sensor.

In some embodiments, the processor can configured to, upon receiving the desired pressure, instruct the pump to pump, and can be configured to, upon receiving a pressure value from the main chamber pressure sensor that equals the desired pressure, instruct the air flow controller to divert air flow from the pump to the air reservoir. The processor can be configured to, upon receiving a pressure value from the reservoir pressure sensor that is greater than the desired pressure, instruct the pump to stop pumping.

In some embodiments, after the main chamber is initially inflated to the desired pressure and the air reservoir is initially filled to a pressure value that is greater than the desired pressure, the processor can be configured to, if the processor receives a pressure value from the main chamber pressure sensor that is less than the desired pressure, instruct the reservoir valve to open.

According to some embodiments, a method for maintaining a desired air pressure in an inflatable object can comprise pumping, with an air pump, air into a main chamber of the inflatable object until an air pressure of the main chamber reaches a desired value, and pumping, with the air pump, air into an air reservoir such that the air pressure of the air reservoir is greater than the air pressure of the main chamber. The method can also include monitoring, via a pressure sensor, the air pressure of the main chamber, and responsive to determining that the air pressure of the main chamber falls below the desired value, releasing air from the air reservoir into the main chamber.

Other implementations, features, and aspects of the disclosed technology are described in detail herein and are considered a part of the claimed disclosed technology. Other implementations, features, and aspects can be understood with reference to the following detailed description, accompanying drawings, and claims.

BRIEF DESCRIPTION OF THE FIGURES

Reference will now be made to the accompanying figures, which are not necessarily drawn to scale, and wherein.

DETAILED DESCRIPTION

Figure 1:
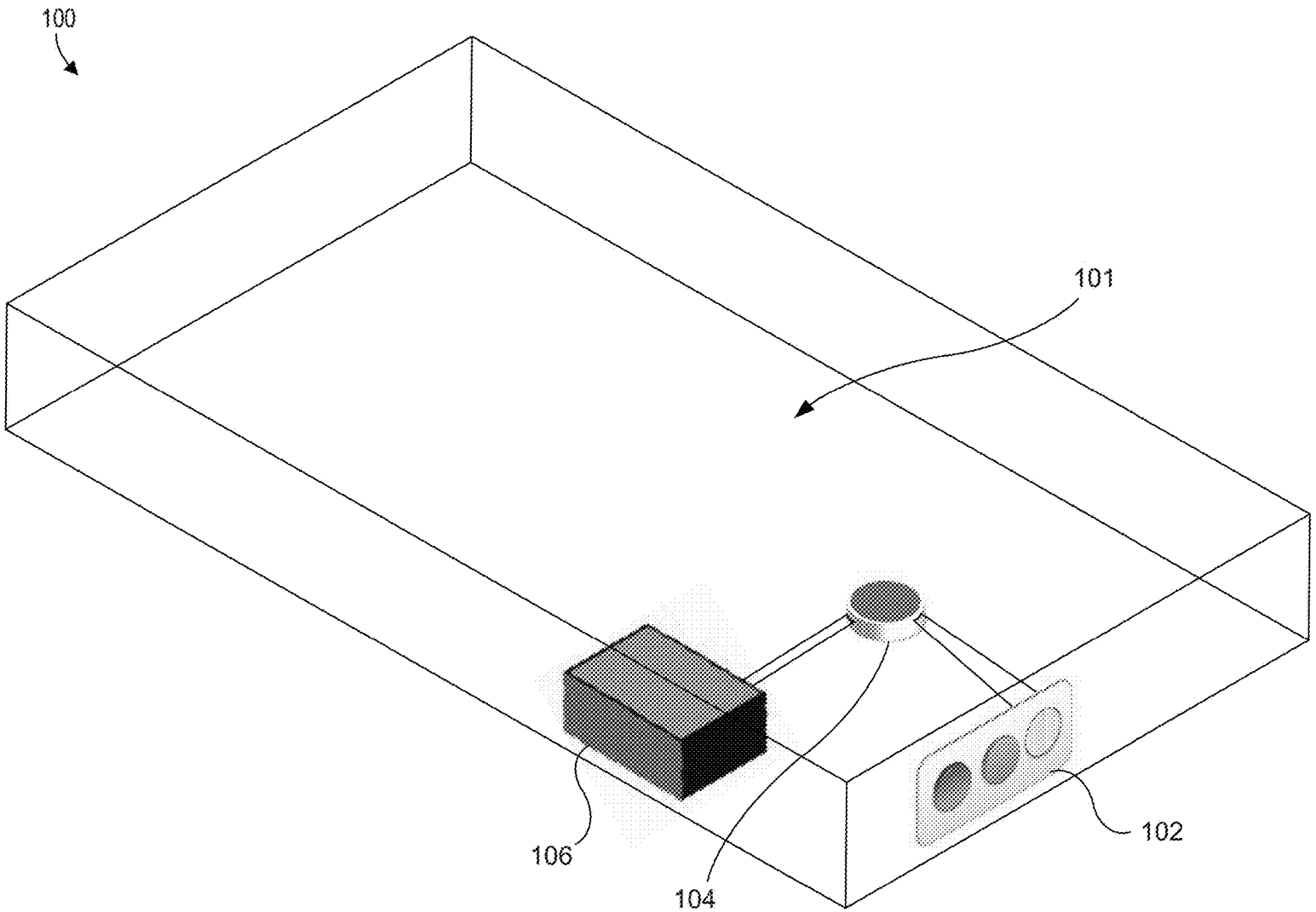
FIG. 1 is a perspective view of a schematic diagram of a pressure-controlled air mattress, in accordance with an example embodiment of the presently disclosed subject matter.

The present disclosure can be understood more readily by reference to the following detailed description of example embodiments and the examples included herein. Before the example embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, example embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the disclosed technology, for example.

Embodiments of the disclosed technology include a pressure-controlled air mattress for enabling a user to set a desired firmness or pressure level of the air mattress. In various embodiments, a pressure-controlled air mattress may automatically maintain the desired pressure by replacing air that has leaked with air from a pressurized air reservoir contained within the air mattress.

Throughout this disclosure, certain embodiments are described in exemplary fashion in relation to maintaining a desired pressure level within an air mattress. But embodiments of the disclosed technology are not so limited. In some embodiments, the disclosed technique may be effective in maintaining a desired pressure level in any other inflatable object, such as balloons, inflatable structures, inflatable supports, or any other such item.

Referring now to the drawings, FIG. 1 illustrates an example embodiment of a pressure-controlled air mattress 100. A pressure-controlled air mattress 100 may enable a user to specify and set a desired mattress pressure or firmness. According to some embodiments, a pressure-controlled air mattress 100 may be enabled to automatically inflate to the desired pressure (or firmness) and may silently, or substantially silently, maintain the desired pressure for a period of time without having to activate a noisy pump that may disturb a user's sleep. A pressure-controlled air mattress 100 may have a top surface, a bottom surface, and one or more side surfaces that may form an inflatable enclosure defining a main chamber 101. According to some embodiments, a pressure-controlled air mattress 100 may include a pump control system 102, an air flow control element 104, and an air reservoir 106. In some embodiments, the air reservoir 106 may be located within the air mattress 100, while in some embodiments, the air reservoir 106 may be located external to the air mattress 100. In some embodiments, the air reservoir 106 may be integral with the air mattress 100, and in certain embodiments, the air reservoir 106 may be separate from the air mattress 100.

Figure 2C:
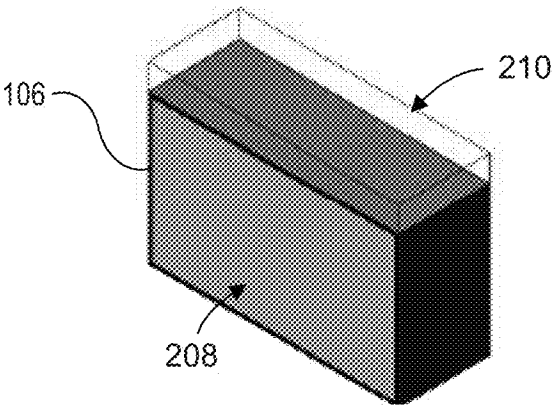
FIG. 2C is a perspective view of a pressured air reservoir, in accordance with an example embodiment of the presently disclosed subject matter.
Figure 2B:
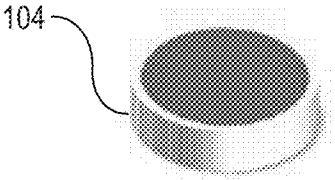
FIG. 2B is a perspective view of an air flow control element, in accordance with an example embodiment of the presently disclosed subject matter.
Figure 2A:
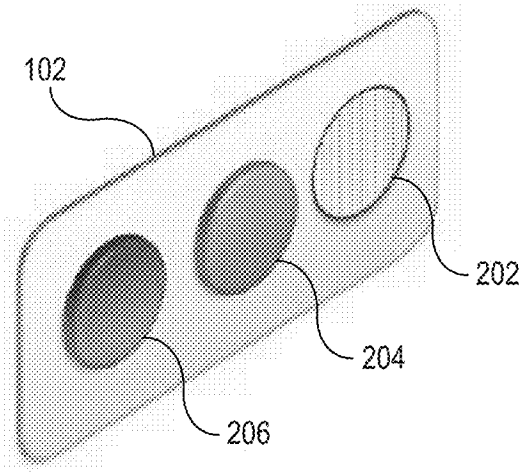
FIG. 2A is a perspective view of a pump control system, in accordance with an example embodiment of the presently disclosed subject matter.

FIG. 2A shows a representation of a pump control system 102. According to some embodiments, a pump control system 102 may be used to control the pressure-controlled air mattress 100 by, for example, placing the pressure-controlled air mattress 100 into one or more operating modes. Operating modes may include, for example, an inflation mode that may cause the air mattress to inflate, a deflation mode that may cause the air mattress to deflate, an air recirculation mode that may cause recirculation of the air mattress air, an automatic pressure control mode which may cause the air mattress to silently, or substantially silently, maintain the desired air pressure upon experiencing an air leak, and a standby mode. According to some embodiments, placing the pressure-controlled air mattress 100 into an operating mode may cause the system to activate an air pump that may blow air into or out of the air mattress 100. In some embodiments, an air pump may be integral to the pressure-controlled air mattress. In some embodiments, an air pump may be external to the pressure-controlled air mattress.

According to some embodiments, the pump control system 102 may include an intake 202, a pump controller 204, and a pressure (or firmness) controller 206. According to some embodiments, the intake 202 may be utilized to direct air from an external air source (such as, for example, ambient air, externally housed air, or compressed air) into the pressure-controlled air mattress 100. For example, when the operating mode is set to inflation mode, air may be pumped into the pressure-controlled air mattress 100 through the intake 202. Furthermore, according to some embodiments, if the operating mode is set to deflation mode, air may be released from or pumped out of the pressure-controlled air mattress 100 through the intake 202.

According to some embodiments, the intake 202 may have an inner seal or valve and/or an outer seal or valve to prevent air from flowing into or out of the pressure-controlled air mattress 202. For example, according to some embodiments, an inner or outer seal may close after the pressure-controlled air mattress 100 is filled with enough air to achieve a desired pressure. Closing the inner or outer seal may prevent air from being released from the pressure-controlled air mattress 100.

According to some embodiments, the pump controller 204 may regulate the operation of an air pump connected to, or integral with, the pressure-controlled air mattress 100. For example, the pump controller 204 may cause the pump to activate, pumping air into or out of the pressure-controlled air mattress 100. According to some embodiments, the pump controller 204 may be configured to cause the closing or opening of an inner or outer seal to seal or open the intake 202. According to some embodiments, the pump controller 204 may be in communication with one or more pressure sensors (e.g., barometers) within the main chamber 101 or the air reservoir 106.

According to some embodiments, the pressure controller 206 may regulate the firmness or pressure of the pressure-controlled air mattress 100. In some embodiments, the pressure controller 206 may be configured to receive a user input indicative of a desired firmness of the air mattress. For example, the pressure controller 206 may allow a user to specify a particular pressure in psi, enter a number representative of a particular pressure level (e.g., a user may enter a number on a scale of 1-100, wherein each number corresponds to a particular pressure level), or otherwise specify a desired pressure level (e.g., the user may be able to select from various options such as "firm," "very firm," and "maximum firm"). In some embodiments, the pressure controller 206 may include a display and have an electronic interface such as, for example, a touch screen or a plurality of buttons allowing a user to input a desired pressure selection. In some embodiments, the pressure controller 206 may include a mechanical element such as a dial, a switch, or one or more buttons that may allow the user to increase or decrease the desired pressure level of the air mattress 100. Similar to the pump controller 204, in some embodiments, the pressure controller 206 may include one or more processors having memory with instructions configured to execute the methods and operations described herein. For example, the pressure controller 206 may cause the pump controller 204 to activate in order to adjust the pressure of the pressure-controlled air mattress 100. According to some embodiments, the pressure controller 206 may be in communication with one or more pressure sensors (e.g., barometers) within the main chamber 101 or the air reservoir 106.

FIG. 2B is a representation of an air flow control element 104. According to some embodiments, the air flow control element 104 may receive air that is pumped into the air mattress through the intake 202. In some embodiments, the air flow control element 104 may maintain a seal with the intake 202 such that any air pumped through the intake 202 must pass through the air flow control element 104 before entering any other portions of the pressure-controlled air mattress 100. An air flow control element 104 may include one or more valves that may open and close to allow the air flow control element 104 to control and direct the flow of air within the main chamber 101 of the pressure-controlled air mattress 100. For example, the air flow control element 104 may include a valve that, when open, enables the flow of air from the air flow control element 104 into the main chamber 101 of the air mattress 100. The air flow control element 104 may also have a valve that, when open, enables the flow of air from the air flow control element 104 into the air reservoir 106. According to some embodiments, the air flow control element 104 may have various flow control modes. For example, in one mode, the air flow control element 104 may direct incoming air to fill the main chamber 101. In another mode, the air flow control element 104 may direct incoming air to fill the air reservoir 106. Further, in some embodiments, the air flow control element 104 may include a processor configured to receive signals instructing the air flow control element 104 to change from one mode to another. According to some embodiments, the air flow control element 104 may control the opening and closing of one or more integral valves to achieve a desired pressure or air flow speed into the main chamber 101 and/or the air reservoir 106. According to some embodiments, the air flow control element 104 may be in communication with one or more pressure sensors (e.g., barometers) within the main chamber 101 or the air reservoir 106.

FIG. 2C is an example representation of an air reservoir 106 of a pressure-controlled air mattress 100. The air reservoir 106 may be a sealed compartment capable of receiving, holding, and releasing pressurized air. According to some embodiments, the air reservoir 106 may be connected (by, for example, a sealed tube) to the air flow control element 104. Accordingly, in some embodiments, the air reservoir 106 may be configured to receive air pumped into the air mattress 100 through the air flow control element 104. In some embodiments, the air reservoir 106 may be designed to contain pressurized air at higher pressures than the main chamber 101. According to some embodiments, the air reservoir 106 may include a valve that, when open, enables the air reservoir 106 to release pressurized air directly into the main chamber 101. In some embodiments, the air reservoir 106 may be configured such that it may release air into the main chamber 101 by releasing it through the air flow control element and into the main chamber 101. According to some embodiments, the air reservoir 106 may be designed to hold air up to a predetermined pressure, wherein the predetermined pressure is greater than a desired pressure of the main chamber 101. FIG. 2C shows a partially filled volume 208 of an air reservoir 106 representing an amount of air that has been received into the air reservoir 106 and an empty volume 210 of the air reservoir 106 that may represent the remaining capacity of the air reservoir 106. FIG. 2C is merely intended to represent an air reservoir 106 that is partially full, meaning that it has not yet achieved a predetermined pressure level, but as will be understood by those of skill in the art, the air density within the air reservoir 106 would be approximately uniformly distributed.

Figure 3:
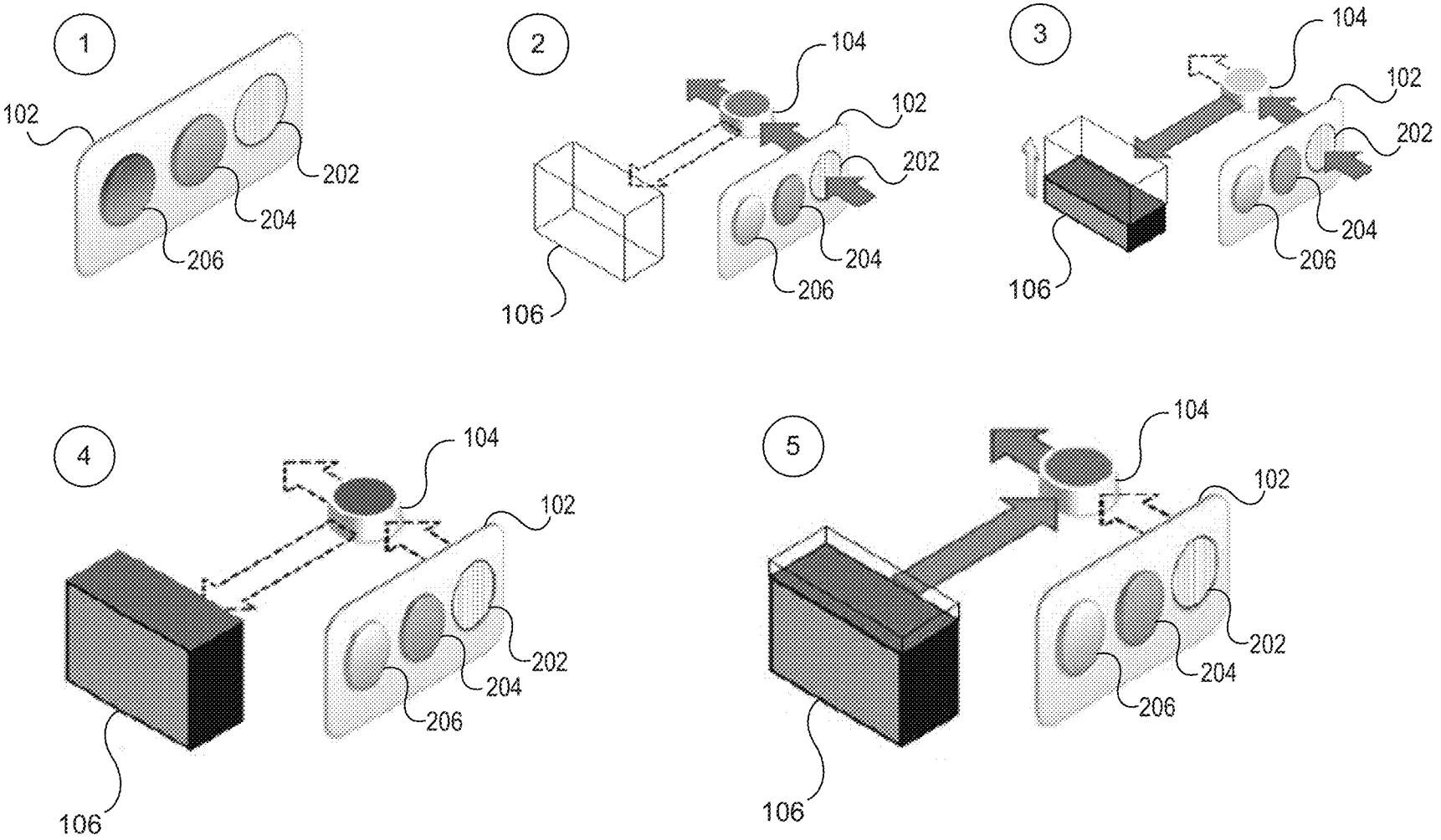
FIG. 3 is a depiction of a method of using a pressure-controlled air mattress, in accordance with an example embodiment of the presently disclosed subject matter.

FIG. 3 illustrates several steps of an example embodiment of a method of use of a pressure-controlled air mattress 100. According to some embodiments, as shown in step 1, a user may input a desired pressure or firmness level (for example, 5 psi) using the pressure controller 206. In some embodiments, a desired pressure may be preprogrammed or predetermined. In some embodiments, the pressure controller 206 may communicate the desired pressure level to the pump controller 204. In some embodiments, the pump controller 204 may be communicatively linked to a pressure sensor within the main chamber 101, which may communicate pressure reading to the pump controller 204. Based on the pressure reading, the pump controller 204 may determine whether the desired pressure is higher or lower than the measured pressure, and may activate the appropriate components (i.e., the pump, valves, and seals) to pump air into the main chamber 101 or release air from the main chamber 101. The pump controller 204 may also determine the speed and duration of the inflation or deflation of air mattress 100. In a case where the desired pressure is higher than the measured pressure, air flow control element 104 may cause air pumped through the intake 202 to pass into the main chamber 101, as shown in step 2.

According to some embodiments, a pressure sensor may monitor the pressure of the main chamber 101, and if the measured pressure matches the desired pressure (e.g., 5 psi), the system may cause the air flow control element 104 to cease sending air into the main chamber 101 and begin sending it into the air reservoir 106, as shown in step 3. As shown in step 4, the air reservoir may eventually fill to a predetermined pressure that is higher than the desired pressure of the air mattress 100 (e.g., 10 psi). The air reservoir 106 may include a separate pressure sensor that may monitor the internal pressure of the air reservoir 106. According to some embodiments, once the pressure in the main chamber 101 is measured to be at the desired pressure level (e.g., using a pressure sensor), and the pressure in the air reservoir 106 is measured to be at the predetermined level, the system may cause all of the valves and seals of the system to close, and may cease pumping air through the intake 202, as shown in step 4.

According to some embodiments, the pressure-controlled air mattress 100 may now have the desired air pressure. But due to imperfections inherent to the manufacturing process, the air mattress 100 may begin to slowly leak air due to an imperfect seal. If this happens, the system may detect that the pressure of the main chamber 101 has dropped below the desired pressure level (e.g., by monitoring performed by a pressure sensor), and the system may then enter an automatic pressure control mode that may silently, or substantially silently, release air from the air reservoir 106 into the main chamber 101 in order to compensate for the leaked air, as shown in step 5. In this way, the pressure-controlled air mattress 100 may quietly maintain the desired pressure of the air mattress 100 until the pressure of the air reservoir 106 reaches equilibrium with the pressure of the main chamber 101. In some embodiments, the system may detect that the pressure of the main chamber 101 has exceeded a predetermined threshold and may release air from the main chamber through a release valve until the pressure of the main chamber 101 falls below the predetermined level. This may protect the pressure-controlled air mattress 100 from rupturing, tearing, or incurring other damage that may result if, for example, too heavy a load is placed on the pressure-controlled air mattress 100.

In some embodiments, the system may determine that the pressure of the main chamber 101 is greater than the desired pressure. In such cases, the system may cause air to be released from the main chamber 101 through the intake 202. In some embodiments, air may be released by the pump control system 102 causing one or more seals of the intake 202 to open. In some embodiments, the pump control system 102 may activate a pump to force air out of the main chamber 101. Once the system detects that the pressure of the main chamber 101 has been reduced to match the desired pressure, the pump control system 102 may cause one or more seals of the intake 202 to close to prevent the further release of air from the air mattress 100.

According to some embodiments, the pressure-controlled air mattress 100 may include a clock or may otherwise receive time information (e.g., from a Wi-Fi interface connected to the internet). In some embodiments, if the air reservoir has released air into the main chamber 101 (for example, over the course of a night), then the pump control system 102 may automatically cause the air reservoir 106 to be refilled to a predetermined pressure by causing a pump to be activated at a predetermined time of day. For example, the pump control system 102 may automatically refill the air reservoir 106 at 2:00 PM every day, because a user may be likely to be at work at that time and may be undisturbed by the noise of the pump. According to some embodiments, the system may enable a user to specify a time or a range of times when the pump control system 102 may be authorized to automatically activate the pump.

One, some, or all of the various valves discussed herein (including, but not limited to, the air flow control valve and the air reservoir valve) may refer to a Boston valve or a relief valve (such as, for example but not limitation, a direct-acting relief valve, a pilot-operated relief valve, a spring-loaded poppet valve, an adjustable, direct-acting relief valve, a guided-piston relief valve, or a differential-piston relief valve). One, some, or all of the various valves discussed herein may refer to a direct acting pressure-reducing valve, a pilot operated pressure-reducing valve, a constant-pressure-reducing valves, a fixed pressure-reducing valve, a sequence valve, a counterbalance valve, an over center valve, an unloading valve, a piloted unloading valve, or any other type of valve of sufficient design as will be apparent to those of skill in the art.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. More specifically, while the above embodiments are disclosed in reference to an inflatable air mattress, the disclosed technology is equally applicable to other inflatable objects. Further, while the above discussed embodiments refer to using air as an inflation medium, the disclosed technology may be used in conjunction with other fluids, such as water or other liquids. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An air mattress system comprising:

an air mattress having a main chamber that is inflatable to a first pressure;

an air reservoir in fluid connection with the main chamber, the air reservoir (i) including an air reservoir valve and (ii) being inflatable to a second pressure that is greater than the first pressure;

an air flow control element in fluid connection with the main chamber and in separate fluid connection with the air reservoir, the air flow control element including an air flow control valve; and a pressure control system in fluid connection with the air flow control element, the pressure control system including a pump and configured to inflate the main chamber and the air reservoir.

2. The air mattress system of claim 1, wherein the pressure control system is operable to pump air into the main chamber and the air reservoir.

3. The air mattress system of claim 1, wherein the air flow control valve is operable to selectively direct air flow between the air intake, the main chamber, and/or the air reservoir.

4. The air mattress system of claim 1, wherein the air reservoir is a substantially airtight compartment, the air reservoir capable of receiving, holding, and releasing pressurized air.

5. The air mattress system of claim 1, wherein the air reservoir valve is operable to open such that air may be released from the air reservoir into the main chamber.

6. The air mattress system of claim 1, wherein the pump is integral with the air mattress.

7. The air mattress system of claim 1, wherein the pump is external to the air mattress.

8. The air mattress system of claim 1 further comprising a main chamber pressure sensor operable to monitor an air pressure of the main chamber.

9. The air mattress system of claim 8, wherein the pressure control system further includes:

an air intake in fluid communication with an external air source and the air flow control element;

a pump controller operable to control the pump; and a pressure controller in electrical communication with the main chamber pressure sensor.

10. The air mattress system of claim 9, wherein the external air source is ambient air.

11. The air mattress system of claim 9, wherein (i) the air reservoir is a substantially airtight compartment capable of receiving, holding, and releasing pressurized air, (ii) the air flow control valve is operable to selectively direct air flow between the air intake, the main chamber, and/or the air reservoir, and (iii) the air reservoir valve is operable to open and close such that air may be released from the air reservoir into the main chamber, and wherein the air mattress system further comprises a processor with memory, the processor configured to (i) control the pump controller and the pressure controller and (ii) receive pressure values from the main chamber pressure sensor.

12. The air mattress system of claim 11 further comprising a user interface in electrical communication with the processor, the user interface configured to receive user input indicative of a desired mattress pressure.

13. The air mattress system of claim 12, wherein the air reservoir further includes an air reservoir pressure sensor operable to monitor an air pressure of the air reservoir, wherein upon receiving the desired mattress pressure, the processor is configured to send instructions to the pump controller to engage the pump, wherein upon receiving a pressure value from the main chamber pressure sensor that equals the desired mattress pressure, the processor is configured to send instructions to the air flow valve to divert air flow from the pump to the air reservoir, and wherein the processor is further configured to receive pressure values from the air reservoir pressure sensor and upon receiving a pressure value from the air reservoir pressure sensor that is greater than the desired mattress pressure, the processor is configured to send instructions to the pump controller to disengage the pump.

14. The air mattress system of claim 13, wherein the processor is in electrical communication with a source of time information, and the processor is further configured to, (i) at a predetermined time of day or during a predetermined range of times and (ii) if an air pressure of the main chamber is below the desired mattress pressure or if an air pressure of the air reservoir is below the pressure value that is greater than the desired mattress pressure, send instructions to the pressure controller and/or pump controller such that the pump pumps air into the main chamber until the air pressure of the main chamber equals the desired mattress pressure and/or into the air reservoir until the air pressure of the air reservoir is greater than the desired mattress pressure.

15. The air mattress system of claim 12, wherein after the main chamber is initially inflated to the desired mattress pressure and the air reservoir is initially filled to a pressure value that is greater than the desired mattress pressure, if the processor receives a pressure value from the main chamber pressure sensor that is less than the desired mattress pressure, the processor is configured to send instructions to the air reservoir valve to open.

16. A system for controlling the air pressure of an inflatable object, the system comprising:

an air flow controller in separate fluid connection with (i) a main chamber of the inflatable object, (ii) an air reservoir configured to hold air at a pressure that is grater than a pressure of air within the main chamber, the air reservoir including a reservoir valve operable to (a) open and establish fluid connection between the air reservoir and the main chamber and (b) close, and (iii) a pump configured to pump air into the main chamber and the air reservoir, the air flow controller operable to selectively direct air flow between the pump, the main chamber, and/or the air reservoir;

a main chamber pressure sensor configured to monitor an air pressure of the main chamber;

a reservoir pressure sensor configured to monitor an air pressure of the air reservoir;

a user input interface configured to receive user input indicative of a desired pressure; and a processor with memory, the processor in electrical communication with the user input interface, the main chamber pressure sensor, and the reservoir pressure sensor and configured to receive pressure values from the main chamber pressure sensor and the reservoir pressure sensor.

17. The system of claim 16, wherein upon receiving the desired pressure, the processor is configured to instruct the pump to pump, wherein upon receiving a pressure value from the main chamber pressure sensor that equals the desired pressure, the processor is configured to instruct the air flow controller to divert air flow from the pump to the air reservoir, and wherein upon receiving a pressure value from the reservoir pressure sensor that is greater than the desired pressure, the processor is configured to instruct the pump to stop pumping.

18. The system of claim 16, wherein after the main chamber is initially inflated to the desired pressure and the air reservoir is initially filled to a pressure value that is greater than the desired pressure, if the processor receives a pressure value from the main chamber pressure sensor that is less than the desired pressure, the processor is configured to instruct the reservoir valve to open.

19. A method for maintaining a desired air pressure in an inflatable object, the method comprising:

pumping, with an air pump, air into a main chamber of the inflatable object until an air pressure of the main chamber reaches a desired value;

pumping, with the air pump, air into an air reservoir such that the air pressure of the air reservoir is greater than the air pressure of the main chamber;

monitoring, via a pressure sensor, the air pressure of the main chamber; and responsive to determining that the air pressure of the main chamber falls below the desired value, releasing air from the air reservoir into the main chamber.

20. The air mattress system of claim 1, wherein the air reservoir is located within the main chamber.

* * * * *